US007014555B1

(12) United States Patent
Issod

(10) Patent No.: US 7,014,555 B1
(45) Date of Patent: Mar. 21, 2006

(54) METHOD AND APPARATUS FOR EXTENDING A CHIMNEY

(76) Inventor: Craig Issod, 8 Golden Cir., Southampton, MA (US) 01073

( * ) Notice: Subject to any disclaimer, the term of this patent is extended or adjusted under 35 U.S.C. 154(b) by 0 days.

(21) Appl. No.: 10/811,550

(22) Filed: Mar. 29, 2004

Related U.S. Application Data

(60) Provisional application No. 60/466,746, filed on May 1, 2003, provisional application No. 60/483,733, filed on Jun. 30, 2003.

(51) Int. Cl.
*E04H 12/28* (2006.01)

(52) U.S. Cl. ..... 454/44; 138/114; 138/159

(58) Field of Classification Search ..... 454/1, 454/3, 13, 14, 35, 44; 52/314; 138/159, 138/160, 114
See application file for complete search history.

(56) References Cited

U.S. PATENT DOCUMENTS

| | | | | | |
|---|---|---|---|---|---|
| 191,230 | A | * | 5/1877 | Entwisle | 454/14 |
| 483,619 | A | * | 10/1892 | Oldershaw | 454/14 |
| 638,172 | A | * | 11/1899 | Burress | 454/12 |
| 674,360 | A | * | 5/1901 | Le Count | 454/12 |
| 850,126 | A | * | 4/1907 | Bayley | 454/12 |
| 1,415,199 | A | * | 5/1922 | Seifert | 52/269 |
| 2,381,178 | A | | 8/1945 | Munyon | |
| 2,830,525 | A | * | 4/1958 | Wilhite | 454/14 |
| 4,250,801 | A | | 2/1981 | Boidron | |
| 4,534,280 | A | * | 8/1985 | Hisey | 454/14 |
| 4,777,871 | A | | 10/1988 | Stowell | |
| 4,878,326 | A | * | 11/1989 | Sass | 52/218 |
| 4,970,837 | A | | 11/1990 | Fogelstrom | |
| 5,025,712 | A | * | 6/1991 | Perry | 454/35 |
| 5,660,011 | A | | 8/1997 | Bleeker et al. | |
| 5,842,918 | A | | 12/1998 | Cowen | |
| 6,066,039 | A | | 5/2000 | Cowen | |
| 6,283,708 | B1 | | 9/2001 | Zelesky | |

* cited by examiner

*Primary Examiner*—Harold Joyce
(74) *Attorney, Agent, or Firm*—Gerry J. Elman; Elman Technology Law, P.C.

(57) ABSTRACT

A flue liner insert with individually adjustable sides, which can be used to fasten to, extend and join two rectangular masonry clay flue tiles. Specifically, this flue liner insert fits into the interior of a clay tile and allows adjustable fastening to existing masonry clay tiles in a manner that can withstand common loads and also not interfere with the chimney draft. This flue liner insert can be used to extend masonry chimneys, join clay flue tiles, anchor ceramic chimney pots, partially or fully line existing chimneys, and mount standard or integrated chimney caps.

7 Claims, 9 Drawing Sheets

METHOD AND APPARATUS FOR EXTENDING A CHIMNEY

CROSS REFERENCE TO RELATED PUBLICATIONS

This application claims benefit to U.S. Provisional Application Ser. No. 60/466,746, filed on May 1, 2003, and U.S. Provisional Application Ser. No. 60/483,733, filed on Jun. 30, 2003, both of which are incorporated herein by reference.

FIELD OF INVENTION

This invention relates to building construction and more specifically to means for improving existing masonry chimneys.

BACKGROUND

Masonry chimneys have been in use for many years. In many cases, these chimneys require extension. One reason for extending a chimney is performance. The height of a chimney affects its draft capability. If the draft is insufficient, the fire may not burn properly, or smoke may enter the living quarters of the home. The external objects surrounding the chimney, such as trees, rooflines, and other chimneys can also affect performance. These objects may direct wind into the chimney, possibly reducing its draft capability under certain wind conditions. Another reason to extend a chimney is to comply with regional building codes, which often stipulate a minimum height above roofline and other adjacent chimneys. One method of extending a chimney is to extend the masonry bricks, and add additional flue tiles. This is a costly and time-consuming method.

SUMMARY OF INVENTION

The present invention provides a flue liner insert having uniquely desirable characteristics. Such an insert can be employed in various methods for extending the length of a chimney. The insert is composed of four pieces, allowing each side of this insert to be independently adjustable. This accommodates the flue tiles, which have a fairly large tolerance, due to the manufacturing process. For example, there can be variation of two inches or more for a side of a particular instance of a given size of flue tile. In addition to variations in the side length, there are variations in the radius of the inner corners of a given flue tile. The present invention accommodates this variation by using an altered corner. With an altered corner, the flue liner insert does not contact the flue tile in its inner corners. By using altered corners, there is minimal restriction of flow due to the insert. This exploits a principle that smoke does not flow through the entire rectangle bounded by the flue tile, but flows within an oval that is circumscribed in the tile. In using the altered corners, the circumscribed oval is preserved when the insert is in use. The present invention has the following advantages:

a) The four-piece design can be disassembled and placed in a compact package for ease of shipping.
b) Each side of this flue liner insert is independently adjustable, thereby accommodating the variation in side length amongst flue tiles of a stated size.
c) This flue liner insert employs altered corners, accommodating the variation in radius of the inner corner amongst flue tiles of a stated size.

d) This flue liner insert minimizes restriction of flow due to the insert.
e) This flue liner insert distributes the load of the chimney extension over a large portion of the supporting flue tile, rather than only the top edge or lip of the supporting flue tile.
f) This flue liner insert facilitates easy installation, without need for excessive masonry work.
g) When designed to accommodate square flue tiles, this flue liner insert is desirably assembled from four identical insert components, minimizing the need to fabricate a multiplicity of different parts.
h) This flue liner insert serves to line and strengthen the existing chimney by using an appropriate length that fits deep into the chimney.

A first aspect of this invention is a flue liner insert comprising four individual components of sheet material. Each component has a cross section that is generally L-shaped with an altered corner. The components together form a vertical flue passage with each component comprising adjustable fastening means such that each component is independently adjustable in position with respect to the other components.

In a second aspect of this invention, the flue liner insert comprises one or more placement tabs extending at a predetermined height of the flue liner insert.

In a third aspect of this invention, the upper portion of the flue liner insert has at least one ventilation hole therein.

A fourth aspect of this invention is a method of using a flue liner insert of the third aspect to extend and terminate a chimney having an existing flue tile at its top. Placement tabs are used to position the flue liner insert at the desired depth within the existing flue tile. A chimney cap is attached to the upper end of the flue liner insert.

A fifth aspect of this invention is a method of using a flue liner insert of the second aspect to extend a chimney having an existing flue tile at its top. Placement tabs are used to position the flue liner insert at the desired depth within the existing flue tile. An extending flue tile is placed over the flue liner insert such that it is either directly or indirectly supported by the existing flue tile.

A sixth aspect of this invention is a flue liner insert as described in the first aspect, wherein the adjustable fastening is accomplished using adjustment slots in the individual components. Threaded studs pass through the slots, and a nut is used on each threaded stud to fasten the components.

A seventh aspect of this invention is a flue liner insert as described in the first aspect, having threaded holes therein adapted to accommodate bolts that can exert force against the inner wall of a flue tile.

An eighth aspect of this invention is a method of using a flue liner insert of the first aspect to extend a chimney having an existing flue tile at its top. The flue liner insert is inserted into an existing flue tile. A metal shroud is placed around the exterior of the flue liner insert and fastened to the flue liner insert.

A ninth aspect of this invention is using the method of the eighth aspect, wherein the flue liner insert has one or more threaded holes, and the metal shroud has one or more holes positioned to correspond to the threaded holes through the flue liner insert. Bolts are used to secure the metal shroud to the flue liner insert.

A tenth aspect of this invention is a method of using a flue liner insert of the first aspect to extend a chimney having an existing flue tile at its top. The flue liner insert is inserted into an existing flue tile. A chimney pot is placed over the flue liner insert.

An eleventh aspect of this invention is using the method of the tenth aspect, wherein the flue liner insert has threaded holes. Bolts are threaded through the holes in the flue liner insert to make contact with and exert force against the chimney pot. This serves to secure the chimney pot over the flue liner insert.

A twelfth aspect of this invention is a method of using a flue liner insert of the first aspect to extend a chimney having an existing flue tile at its top. The flue liner insert is inserted into an existing flue tile. A metal shroud is placed around the exterior of the flue liner insert. An insulating material is inserted between the exterior of the flue liner and the interior of the metal shroud. The metal shroud is fastened to the flue liner insert.

A thirteenth aspect of this invention is a flue liner insert of the first aspect, wherein the altered corner is a beveled corner.

A fourteenth aspect of this invention is a flue liner insert of the first aspect, wherein the altered corner is an inverted corner.

A fifteenth aspect of this invention is a flue liner insert of the first aspect, wherein the altered corner is an outwardly rounded corner.

A sixteenth aspect of this invention is a flue liner insert of the first aspect, wherein the altered corner is an inwardly rounded corner.

A seventeenth aspect of this invention is a flue liner insert of the first aspect, further comprising an adjustable expansion mechanism.

DETAILED DESCRIPTION

Figure 1A:
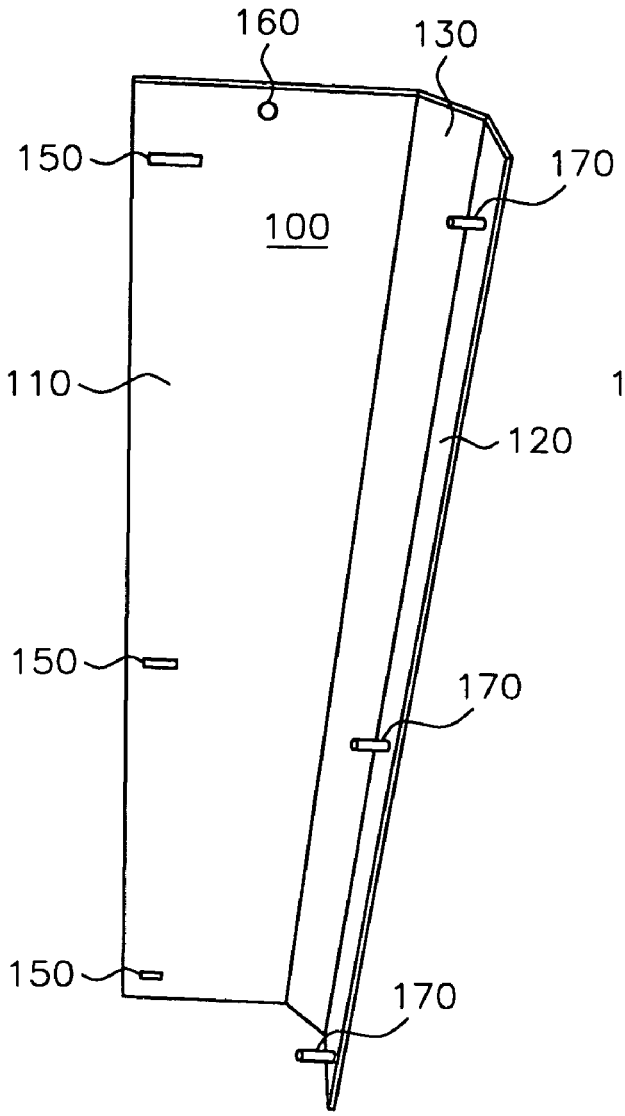
FIG. 1A shows an individual insert component for assembling with other components into a flue liner insert of the present invention.
Figure 2:
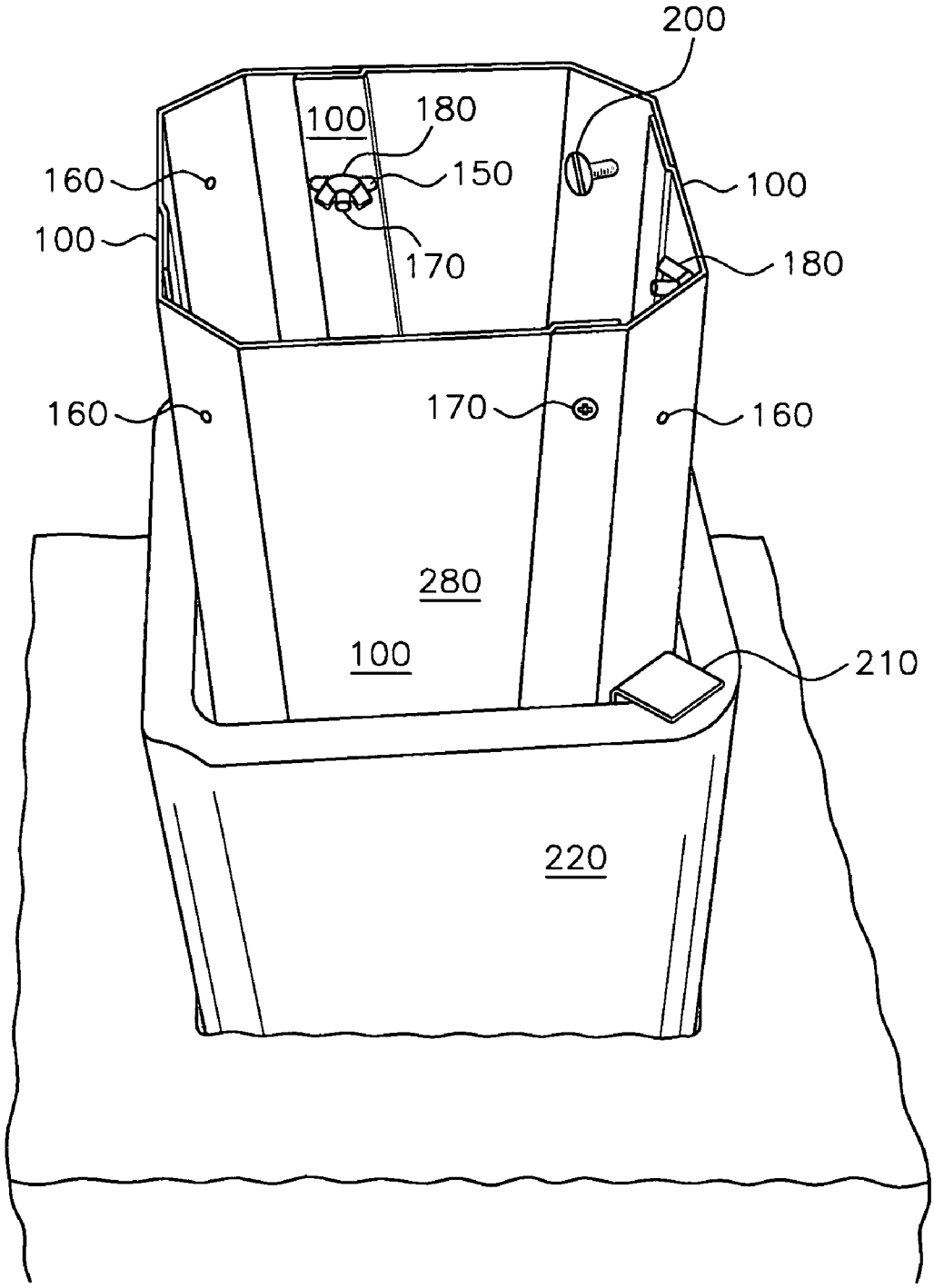
FIG. 2 shows four individual components assembled to form a flue liner insert of the present invention, which is shown inserted into a flue tile. This figure also shows the optional placement tabs, which help place the insert at a pre-determined depth into the existing chimney.

FIG. 1A shows an embodiment of an individual component 100 of a flue liner insert in accordance with the invention. Each component comprises a wall portion 110 connected to a corner piece 130 at an angle. A second wall portion 120 is connected at the opposite side of the corner piece 130 at an angle, resulting in wall portion 110 being approximately perpendicular to wall portion 120. The outermost part of wall portion 110 has one or more adjustment slots 150. Wall portion 120 contains one or more threaded studs 170, with the same alignment and spacing as the adjustment slots 150. Optionally, holes to accommodate separate bolts can be used in place of threaded studs (not shown). The individual component may optionally contain threaded holes 160 for the purpose of accommodating bolts that make contact with a flue tile. The threaded holes 160, while shown in a wall portion, may also reside in the corner piece 130, as shown in FIG. 2. The component 100 is desirably fabricated of a single sheet of metal.

Figure 1B:
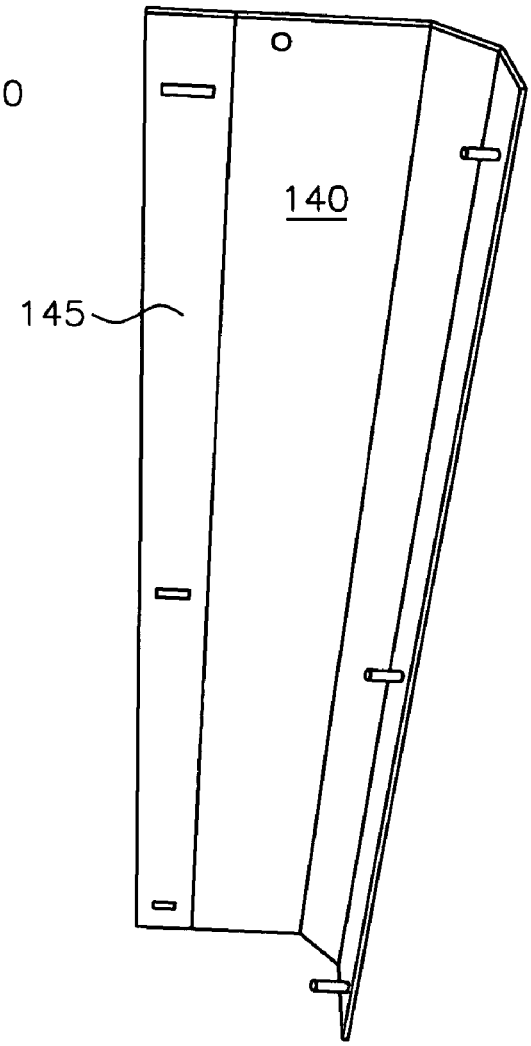
FIG. 1B shows an individual insert component with an offset, to be used for assembling with other components into a flue liner insert of the present invention.

FIG. 1B shows an individual component 140 which has an offset 145. The offset 145 allows the individual components to fit together forming a straight exterior wall, which maximizes the volume of the flue liner insert.

Figure 1C:
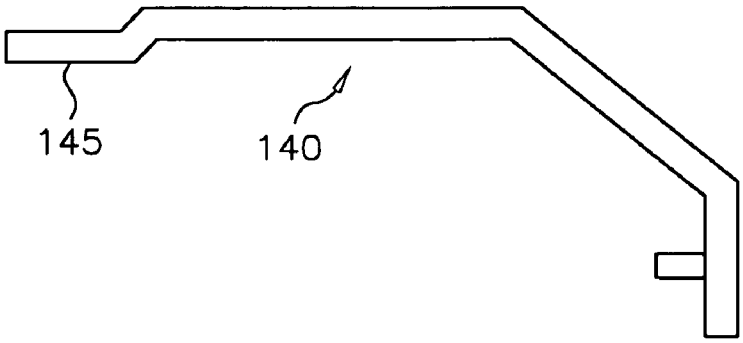
FIG. 1C shows a top view of an individual insert component with an offset, to be used for assembling with other components into a flue liner insert of the present invention.

FIG. 1C shows a top view of the individual component 140 of FIG. 1B. The offset 145 allows the individual components to fit together forming a straight exterior wall, which maximizes the volume of the flue liner insert.

FIG. 2 shows a flue liner insert 280 assembled from four individual components 100. The threaded studs 170 of one individual component 100 penetrate the adjustment slots 150 of the adjacent individual component 100. Desirably, nuts 180 may secure the individual components to each other by being tightened onto the threaded studs 170. In the embodiment shown, wing nuts are used, which allow fastening by hand. Those skilled in the art will recognize that other fastening means are possible. As it is being assembled, the flue liner insert is adjusted to fit snugly into the existing flue tile 220. Optionally, bolts 200 may be threaded through threaded holes 160 to provide additional friction when inserted in the existing flue tile 220. An alternative embodiment of the invention as shown in FIG. 2 includes a placement tab 210 attached to the flue liner insert 280. In one exemplary embodiment, the placement tab 210 is attached to each corner of the flue liner insert 280. Those skilled in the art will recognize that other locations are possible. The placement tab 210 limits the depth that the flue liner insert 280 may be inserted into the existing flue tile 220.

Figure 3:
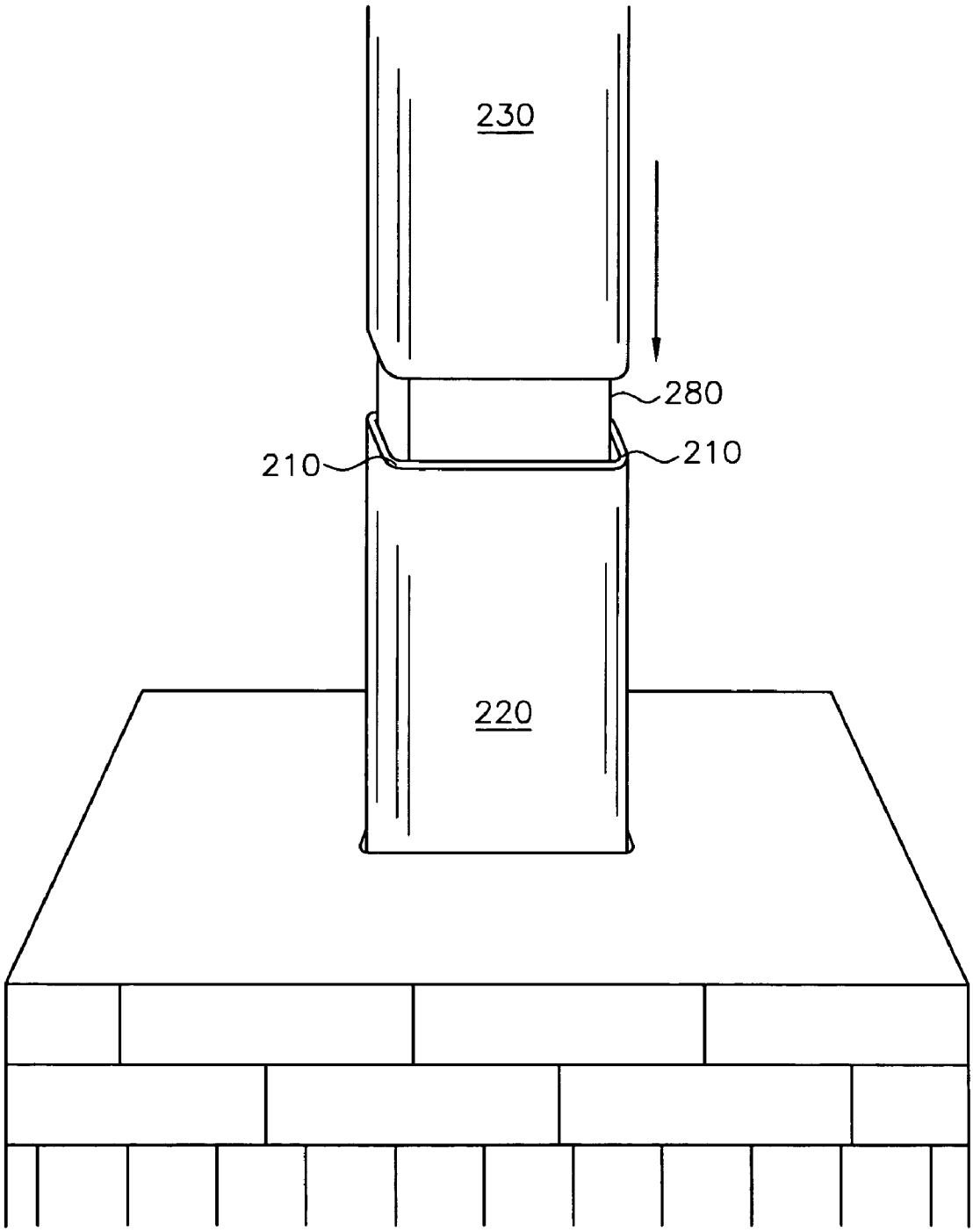
FIG. 3 shows a flue liner insert similar to the insert shown in FIG. 2, joining two flue tiles.

FIG. 3 shows the use of the flue liner insert to facilitate adding an additional flue tile to a chimney. This method involves inserting the flue liner insert 280 into the existing flue tile 220, optionally using one or more placement tabs 210 to ensure that a predetermined portion of the flue liner insert is inserted into the existing flue tile. Next, an extending flue tile 230 is placed onto the portion of the insert that protrudes from the existing flue tile. The extending flue tile 230 fits over the flue liner insert 280 and is supported by the existing flue tile 220. In this way, the extending flue tile 230 serves to extend the chimney without the need for extensive masonry work.

Figure 4:
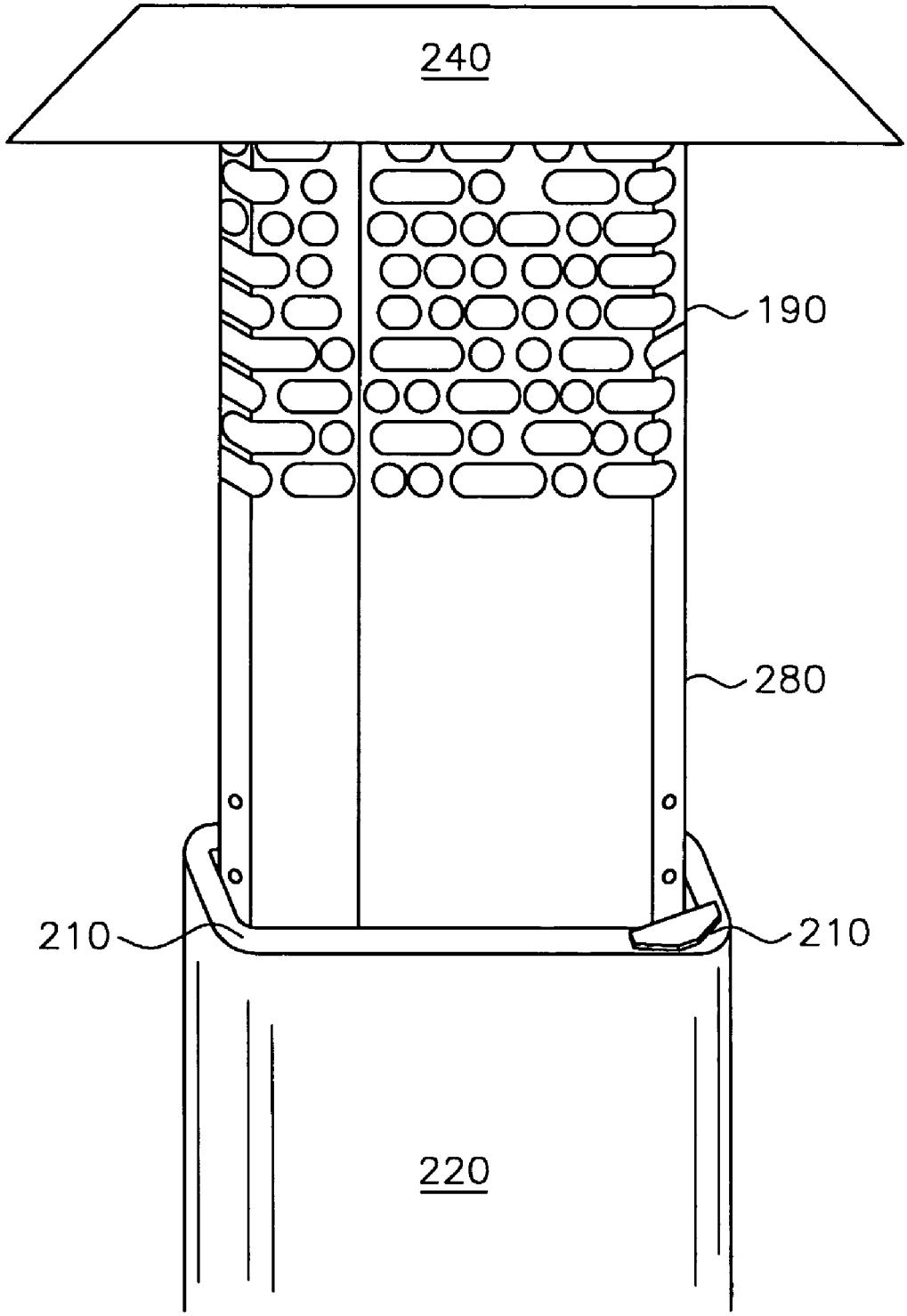
FIG. 4 shows a flue liner insert similar to the insert shown in FIG. 2 with ventilation holes, thereby forming a chimney termination device.

FIG. 4 shows another embodiment of a chimney termination device in accordance with this invention. Here, the termination device is a chimney cap 240. Placement tabs 210 may be used to help place the flue liner insert into the existing flue tile 220 at a pre-determined depth. In this embodiment, the upper portion of the flue liner insert 280 is vented by means of adding a plurality of ventilation holes 190. Those skilled in the art will recognize that other shaped holes are possible for the purposes of ventilation. In another embodiment, an open area can be used in place of ventilation holes. Ventilation may also be facilitated using a screen material in place of, or in combination with the ventilation holes 190.

Figure 5:
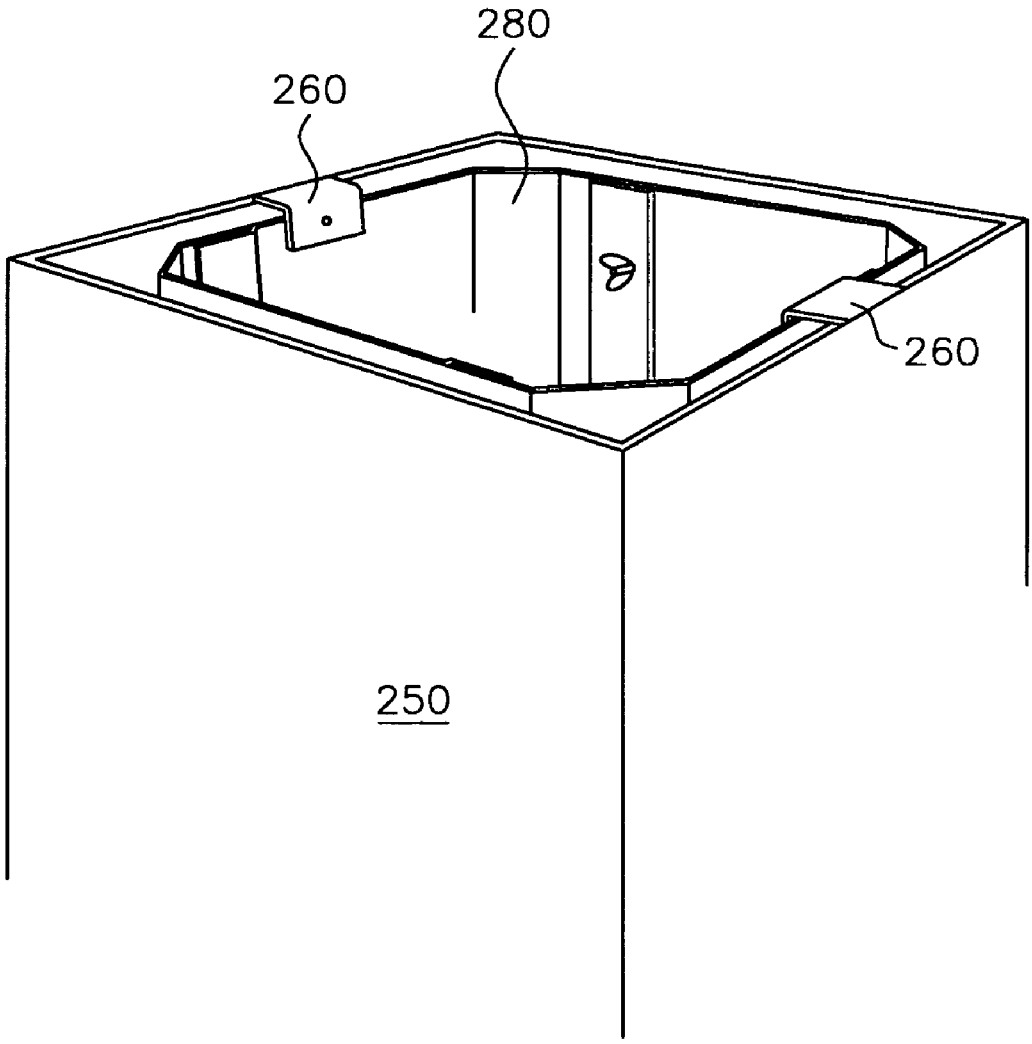
FIG. 5 shows a flue liner insert similar to the insert shown in FIG. 2 supporting a sheet metal decorative shroud.

FIG. 5 shows a metal shroud 250 that covers the flue liner insert 280. In an exemplary embodiment, L-shaped brackets 260 fasten the metal shroud 250 to the flue liner insert 280. Those skilled in the art will recognize that other means of fastening the metal shroud 250 to the flue liner insert 280 are possible. The metal shroud 250 can serve to further protect the flue liner insert 280, and also provides a decorative element for the chimney.

Figure 6:
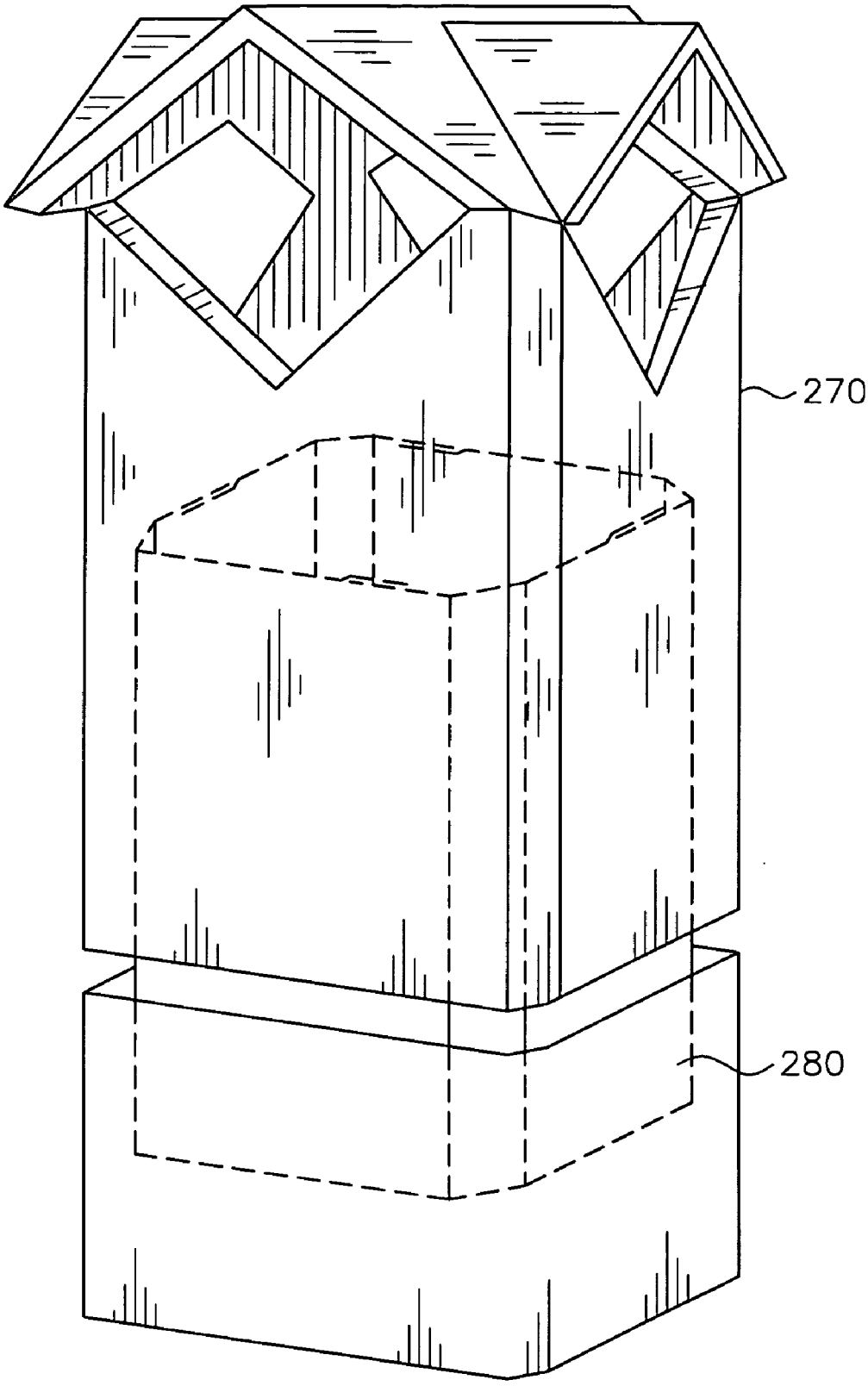
FIG. 6 shows a flue liner insert similar to the insert shown in FIG. 2, supporting a decorative clay chimney pot with an integrated flue tile.

FIG. 6 shows an integrated clay chimney pot 270, which has an integrated flue tile, attached using a flue liner insert 280. The integrated clay chimney pot 270 can serve to further protect the flue liner insert 280, and also serves as a decorative element for the chimney.

FIGS. 7A–7D show various embodiments of an altered corner.

Figure 7A:
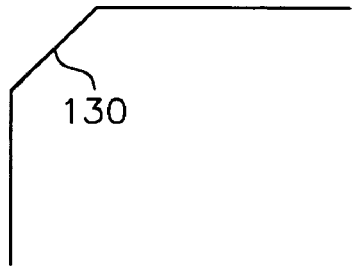
FIGS. 7A–7D show various embodiments of an altered corner.

FIG. 7A shows an individual component with a beveled corner piece 130.

Figure 7B:
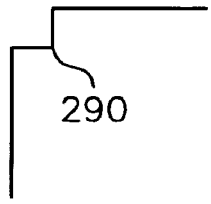

FIG. 7B shows an individual component with an inverted corner 290 formed by two perpendicular intersecting flanges.

Figure 7C:
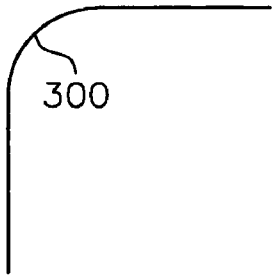

FIG. 7C shows an individual component with an outwardly rounded corner 300.

Figure 7D:
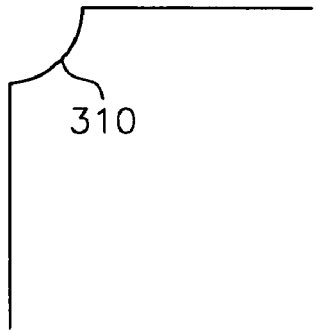

FIG. 7D shows an individual component with an inwardly rounded corner 310.

Those skilled in the art will recognize that other variations of altered corners may be possible, but they will function in the same manner as the embodiments mentioned herein.

Figure 8:
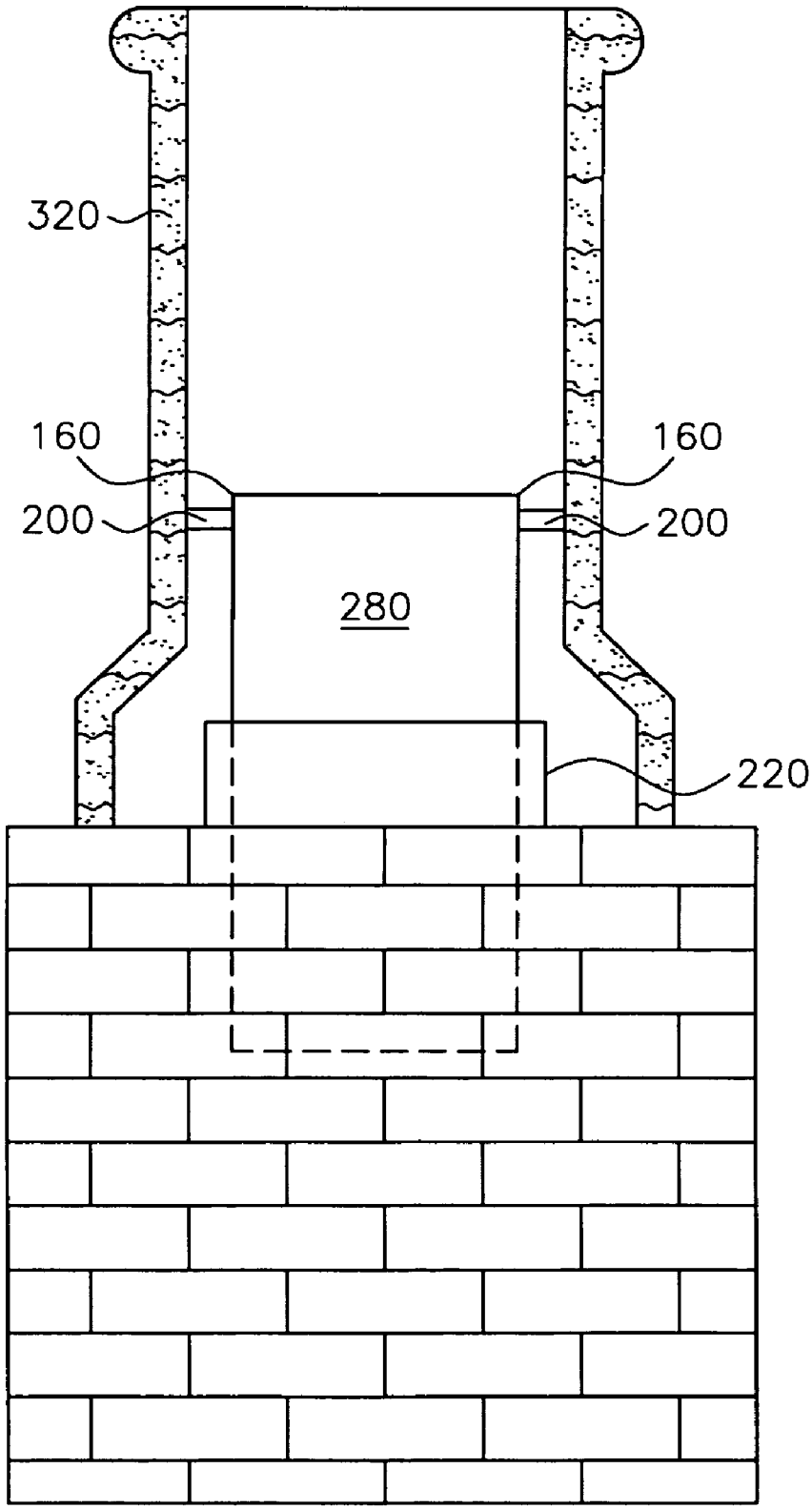
FIG. 8 shows a flue liner insert similar to the insert shown in FIG. 2, supporting a decorative clay chimney pot that fits over an existing flue tile.

FIG. 8 shows a fit-over clay chimney pot 320 that fits over an existing flue tile 220. To provide additional support, bolts 200 may be threaded through threaded holes 160 in the flue liner insert 280 to make contact with the fit-over chimney pot 320.

Figure 9:
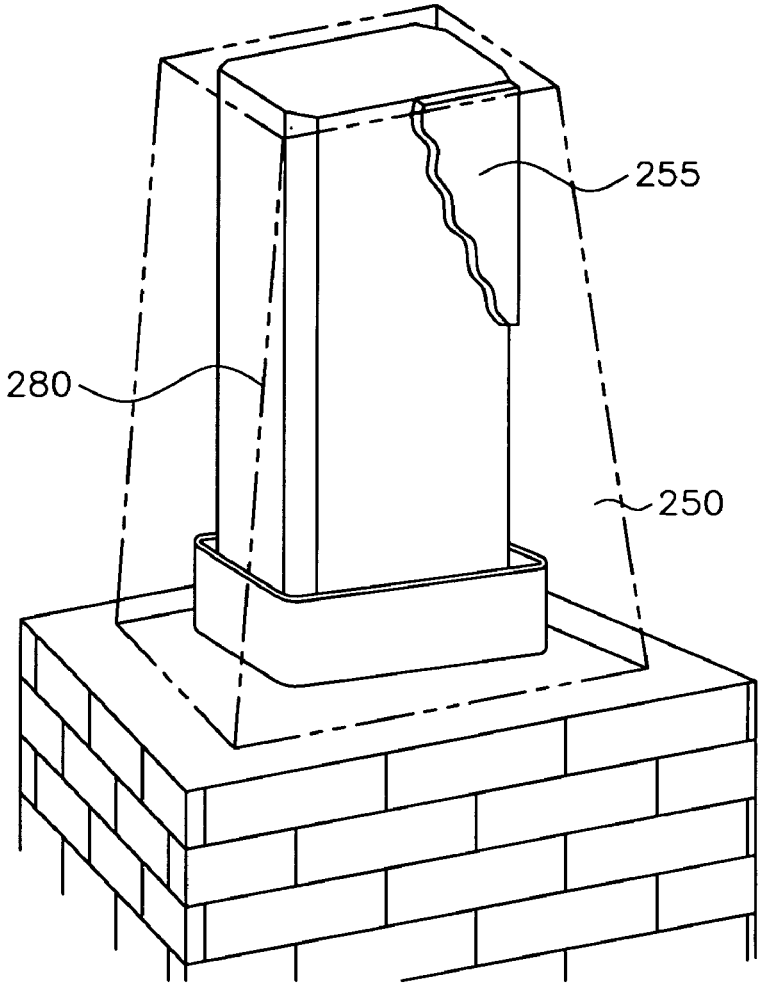
FIG. 9 shows an embodiment with insulation placed between the flue liner insert and the metal shroud.

FIG. 9 shows an embodiment with insulation placed between the flue liner insert 280 and the metal shroud 250. The insulation 255 surrounds the flue liner insert 280, and serves to keep flue gases warm, which increases draft and reduces condensation in the chimney. The insulation 255 also reduces the temperature of the outer surface of the metal shroud 250, thereby serving to reduce the risk of a chimney fire. In one embodiment, the type of insulation used is flexible vitreous fiber, which is readily available from multiple vendors.

Figure 10:
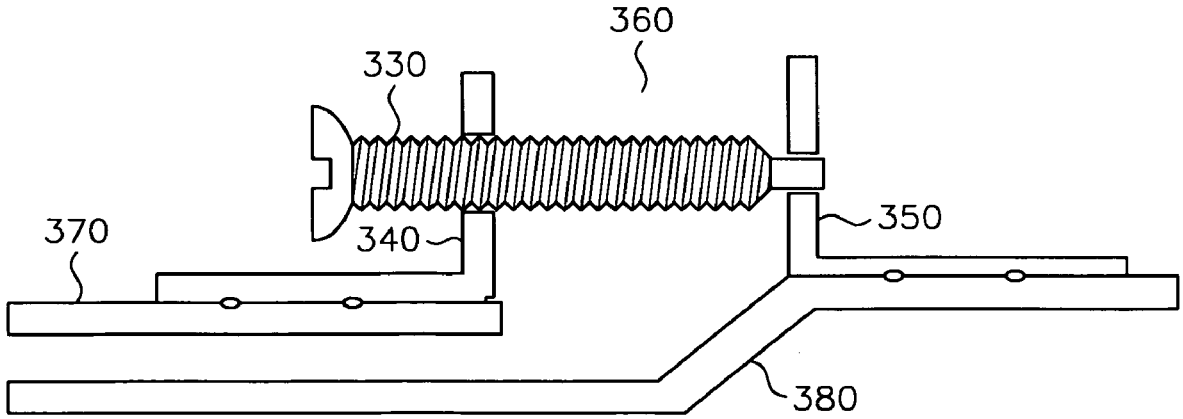
FIG. 10 shows an embodiment with an adjustable expansion mechanism to facilitate the fitting of the flue insert tightly against the flue tile walls.

FIG. 10 shows an embodiment with an adjustable expansion mechanism 360 to facilitate the fitting of the flue insert tightly against the flue tile walls. The embodiment shown consists of a machine screw 330 that is threaded through a threaded bracket 340 on a first individual component 370 and makes contact with a solid bracket 350 on a second individual component 380. Those skilled in the art will recognize that other variations of an adjustable expansion mechanism, including cams and wedges, may be possible, but they will serve the same purpose as the embodiment mentioned herein.

Operation

To modify a chimney in accordance with the present invention, a user first measures the sides of the particular flue tile of the chimney that is to be extended. Optionally, placement tabs 210 can help the user determine how far into the existing flue tile the flue liner insert 280 is to be inserted. The four sides of the flue liner insert are placed against the inner walls of the flue tile. In an optional embodiment, the individual flue liner insert components 100 may have line markings to assist the user in setting the flue liner insert to the proper size for the given flue tile.

To provide additional friction between the flue liner insert and the existing flue tile 220 or extending flue tile 230, bolts 200 are desirably inserted into threaded holes 160 such that the ends of the bolts 200 protrude through the flue liner insert 280 to contact the flue tile.

The portion of the flue liner insert that protrudes from the existing flue tile may be covered with a sheet metal shroud 250 for decorative and insulating purposes. Optionally, an insulating material may be placed between the flue liner insert and the metal shroud 250.

The flue liner insert can be used with two types of chimney pots; integrated chimney pots, and fit-over chimney pots. The integrated chimney pot has an interior with dimensions similar to that of a flue tile. The fit-over chimney pot has an interior with dimensions larger than that of a flue tile.

In another embodiment, a fit-over clay chimney pot 320 may be placed over the portion of the flue liner insert that protrudes from the existing flue tile for decorative and insulating purposes. To provide additional support, bolts 200 may be threaded through threaded holes 160 to make contact with the fit-over chimney pot 320. Optionally, an insulating material may be placed between the flue liner insert and the fit-over clay chimney pot 320.

In an alternative embodiment, the flue liner insert 280 can be used to join two flue tiles together, as shown in FIG. 3.

In another embodiment, the flue liner insert 280 may function as a chimney termination device, such as a chimney cap 240, or serve for mounting of same. Furthermore, the flue liner insert 280 may serve as a mounting bracket onto which other assemblies can be mounted.

In another embodiment, the flue liner insert is part of a chimney assembly comprised of; the flue liner insert 280, a metal shroud 250, and insulation 255 between the metal shroud 250 and the flue liner insert 280.

In another embodiment, the flue liner insert may be equipped with an adjustable expansion mechanism 360 to facilitate the fitting of the flue insert tightly against the flue tile walls.

CONCLUSION

Accordingly, the reader will see that the flue liner insert of this invention can be used to quickly and economically extend a chimney to improve performance, and meet regional building codes. In addition, the four piece design accommodates the wide fluctuation found in flue tiles of a given size. The configuration of the insert of the present invention allows it to be shipped in an unassembled state to facilitate a compact package for ease of distribution.

Although the description above contains specific details, these should not be construed as limiting the scope of the invention, but as merely providing illustrations of some of the presently preferred embodiments of this invention. The scope of the invention should be determined by the appended claims and their legal equivalents, rather than by the examples given.

What is claimed is:

1. A flue liner insert comprising four individual substantially identical components of sheet material, each component having a cross section that is generally L-shaped with a beveled corner, the components together forming a vertical flue passage of substantially constant cross sectional area throughout the length of said vertical flue passage, each component comprising adjustable fastening means such that each component is independently adjustable in position with respect to the other components.

2. The flue liner insert of claim 1, wherein the flue liner insert further comprises one or more placement tabs extending at a predetermined height of the flue liner insert.

3. The flue liner insert of claim 2, wherein the upper portion of the flue liner insert has at least one ventilation hole therein.

4. A method of using a flue liner insert of claim 3 to extend and terminate a chimney having an existing flue tile at its top, comprising:

a) Inserting the flue liner insert into the existing flue tile at a depth predetermined by the location of a placement tab; and b) Attaching a chimney cap to the upper end of the flue liner insert.

5. A method of using a flue liner insert of claim 2 to extend a chimney having an existing flue tile at its top, comprising:

a) Inserting the flue liner insert into the existing flue tile at a depth predetermined by the location of a placement tab; and b) Placing an extending flue tile over the flue liner insert such that it is directly or indirectly supported by the existing flue tile.

6. A method of using a flue liner insert of claim 1 to extend a chimney having an existing flue tile at its top, comprising:

a) Inserting the flue liner insert into an existing flue tile;

b) Placing a metal shroud around the exterior of the flue liner insert; and c) Fastening the metal shroud to the flue liner insert.

7. A method of using a flue liner insert of claim 1 to extend a chimney having an existing flue tile at its top, comprising:

a) Inserting the flue liner insert into an existing flue tile; and b) Placing a chimney pot over the flue liner insert.

* * * * *